US008192523B1

(12) United States Patent
Kaufman et al.

(10) Patent No.: US 8,192,523 B1
(45) Date of Patent: Jun. 5, 2012

(54) DEVICE AND METHOD FOR SEPARATING AND INCREASING THE CONCENTRATION OF CHARGED PARTICLES IN A SAMPLED AEROSOL

(75) Inventors: Stanley L. Kaufman, New Brighton, MN (US); Jeremy Kolb, St. Paul, MN (US); Ricky L. Holm, White Bear Lake, MN (US)

(73) Assignee: TSI Incorporated, Shoreview, MN (US)

( * ) Notice: Subject to any disclaimer, the term of this patent is extended or adjusted under 35 U.S.C. 154(b) by 632 days.

(21) Appl. No.: 12/391,068

(22) Filed: Feb. 23, 2009

Related U.S. Application Data

(60) Provisional application No. 61/066,772, filed on Feb. 22, 2008.

(51) Int. Cl.
*B03C 3/34* (2006.01)

(52) U.S. Cl. ..... 95/3; 95/8; 96/19; 96/52; 96/413; 96/418; 128/200.24; 128/202.22; 128/205.29

(58) Field of Classification Search ..... 95/2, 3, 95/8, 25, 31–33, 57, 58, 78; 96/18, 19, 25, 96/26, 52, 60, 63, 413, 414, 417, 418; 55/434, 55/462; 128/200.24, 202.22, 205.27, 205.29; 73/28.01, 28.02, 28.04, 28.05, 31.07
See application file for complete search history.

(56) References Cited

U.S. PATENT DOCUMENTS

| | | | |
|---|---|---|---|
| 3,114,877 | A | 12/1963 | Dunham |
| 3,237,375 | A | 3/1966 | Schwarz et al. |
| 3,392,573 | A | 7/1968 | Benson et al. |
| 3,413,545 | A | 11/1968 | Whitby |
| 3,496,701 | A | 2/1970 | Owe Berg |
| 3,635,340 | A | 1/1972 | Dunn |
| 3,763,428 | A | 10/1973 | Preist |
| 3,806,248 | A | 4/1974 | Sinclair |
| 4,055,075 | A | 10/1977 | Allan et al. |

(Continued)

FOREIGN PATENT DOCUMENTS

| | | |
|---|---|---|
| EP | 1 540 308 | 6/2005 |

(Continued)

OTHER PUBLICATIONS

Chang et al., "Field evaluation of a mobile high-capacity particle size classifier (HCPSC) for separate collection of coarse, fine and ultrafine particles," Journal of Aerosol Science, (2001), pp. 139-156.

(Continued)

*Primary Examiner* — Richard L Chiesa
(74) *Attorney, Agent, or Firm* — Patterson Thuente Christensen Pedersen P.A.

(57) ABSTRACT

A respirator leak detection system and method for increasing the sensitivity and accuracy of leak detection through the fit seal of a respirator. A charged particle separator is used to separate charged particles that pass therethrough and to draw charged particles away from an aerosol flow into a clean gas flow. The separator may also be configured as an aerosol concentrator that takes in a major aerosol flow and outputs a minor flow of higher particle concentration. Neutral particles having no charge, which may have passed through the filtering medium respirator and which are not indicative of fit seal leaks are not entrained in the output flow for subsequent detection, thus increasing the accuracy of the filter leak detection system.

17 Claims, 4 Drawing Sheets

U.S. PATENT DOCUMENTS

| | | | | |
|---|---|---|---|---|
| 4,137,750 | A | 2/1979 | French et al. | |
| 4,233,037 | A | 11/1980 | Pontius et al. | |
| 4,255,176 | A | 3/1981 | Macrow | |
| 4,312,180 | A | 1/1982 | Reif et al. | |
| 4,324,568 | A | 4/1982 | Wilcox et al. | |
| 4,402,214 | A | 9/1983 | Morgan et al. | |
| 4,494,403 | A | 1/1985 | Bowers et al. | |
| 4,515,007 | A | 5/1985 | Herman | |
| RE31,952 | E | 7/1985 | Wilcox et al. | |
| 4,676,092 | A | 6/1987 | Tuttle | |
| 4,767,524 | A | 8/1988 | Yeh et al. | |
| 4,896,174 | A | 1/1990 | Stearns | |
| 4,905,683 | A | 3/1990 | Cronjaeger | |
| 4,914,957 | A | 4/1990 | Dougherty | |
| 4,972,957 | A | 11/1990 | Liu et al. | |
| 5,117,190 | A | 5/1992 | Pourprix | |
| 5,150,036 | A | 9/1992 | Pourprix | |
| 5,299,448 | A | 4/1994 | Maryyanek et al. | |
| 5,428,220 | A | 6/1995 | Ehara | |
| 5,439,513 | A | 8/1995 | Periasamy et al. | |
| 5,592,096 | A | 1/1997 | Pourprix | |
| 5,596,136 | A | 1/1997 | Flagan et al. | |
| 5,606,112 | A | 2/1997 | Flagan et al. | |
| 5,755,333 | A | 5/1998 | Stencel et al. | |
| 5,855,652 | A | 1/1999 | Talley | |
| 5,882,378 | A * | 3/1999 | Tarutani et al. | 95/8 |
| 5,938,041 | A | 8/1999 | Stencel et al. | |
| 5,973,904 | A | 10/1999 | Pui et al. | |
| 6,003,389 | A | 12/1999 | Flagan et al. | |
| 6,012,343 | A | 1/2000 | Boulaud et al. | |
| 6,125,845 | A | 10/2000 | Halvorsen et al. | |
| 6,504,149 | B2 | 1/2003 | Guevremont et al. | |
| 6,761,752 | B2 | 7/2004 | Fissan et al. | |
| 6,773,489 | B2 | 8/2004 | Dunn | |
| 6,827,761 | B2 | 12/2004 | Graham | |
| 6,905,029 | B2 | 6/2005 | Flagan | |
| 6,955,170 | B1 | 10/2005 | Mullins et al. | |
| 6,989,049 | B2 * | 1/2006 | Belson et al. | 96/2 |
| 6,992,284 | B2 | 1/2006 | Schultz et al. | |
| 7,041,153 | B2 * | 5/2006 | Totoki | 95/3 |
| 7,086,535 | B2 | 8/2006 | Stencel et al. | |
| 7,105,041 | B2 | 9/2006 | Dunn | |
| 7,186,286 | B2 | 3/2007 | Morse | |
| 7,199,362 | B2 | 4/2007 | Rockwood et al. | |
| 7,223,969 | B2 | 5/2007 | Schultz et al. | |
| 7,235,123 | B1 | 6/2007 | Biegelsen | |
| 7,381,245 | B2 * | 6/2008 | Fleischer | 96/18 |
| 7,393,380 | B2 * | 7/2008 | Vie et al. | 95/8 |
| 7,857,892 | B2 * | 12/2010 | Marra | 96/19 |
| 2004/0089803 | A1 | 5/2004 | Foley | |
| 2006/0102525 | A1 | 5/2006 | Volkel et al. | |
| 2006/0219602 | A1 | 10/2006 | Stencel et al. | |
| 2006/0284077 | A1 | 12/2006 | Fissan et al. | |
| 2007/0234901 | A1 | 10/2007 | Pletcher et al. | |
| 2009/0277325 | A1 * | 11/2009 | Gottung et al. | 95/8 |

FOREIGN PATENT DOCUMENTS

| | | | |
|---|---|---|---|
| JP | 59-60018 A | * | 4/1984 |
| WO | WO 8702898 | | 5/1987 |
| WO | WO 03049866 | | 6/2003 |
| WO | WO 2004/097396 | | 11/2004 |
| WO | WO 2007/035543 | | 3/2007 |

OTHER PUBLICATIONS

Fjeld et al., "The Effect of Particle Charge on Penetration in an Electret Filter," IEEE Transactions on Industry Application. (1988), vol. 24, No. 4, pp. 725-731.

Hutchins et al., "Electrodynamic Focusing of Charged Aerosol Particles," Aerosol Science and Technology, (1991), pp. 389-405.

Liu et al., "Respirator Leak Detection by Ultrafine Aerosols: A Predictive Model and Experimental Study," Aerosol Science and Technology, (1993), pp. 15-26.

Coyle et al., "Electrostatic Enhanced Compact Aerosol Concentrator Development," SARNOFF Corporation, (2003).

Medaglia et al., "SpinCon Based Air Sampler Foot and Mouth Disease Virus (FMDV) Test Report," SCEPTOR Industries, Inc., (2001).

Sibata, "Mask Fitting Tester," (2003), http://www.sibata.co.jp/~overseas/product/english_mt-03.html.

Tsi, "Portacount Respirator Fit Tester," http://www.tsi.com/en-1033/products/14020/portacount®_respriator_fit_tester/2248/8038, (2009).

Tsi, "Respirator Fit Testing, PortaCount Plus Model 8020, Operation and Service Manual," (2006), pp. 1-66.

Tsi, "Respirator Fit Testing, Model 8095, N-95—Companion to the PortaCount Plus, Operation and Service Manual," (2005), pp. 1-47.

* cited by examiner

DEVICE AND METHOD FOR SEPARATING AND INCREASING THE CONCENTRATION OF CHARGED PARTICLES IN A SAMPLED AEROSOL

RELATED APPLICATIONS

This application claims the benefit of U.S. Patent Application No. 61/066,772 filed on Feb. 22, 2008, which is hereby incorporated by reference in its entirety.

FIELD OF THE INVENTION

The invention relates generally to devices and methods for evaluating filtration devices as to leakage. More particularly, the invention relates to quantitative fit-testing of respirators and masks.

BACKGROUND

The testing of particle filter systems for leaks (e.g. openings in the filter, gaps or imperfections in the sealing of the air path) generally involves reducing or eliminating the contribution of particles which penetrate through the filter medium itself. The reduced contribution is typically accomplished by using test particles which are known to be removed efficiently by the filter medium.

A common method of quantitative fit-testing involves taking particle concentration measurements, both inside of a respirator mask and just outside of the mask. This is accomplished by using a vacuum pump to draw an aerosol sample from the atmosphere just outside the mask, and then drawing another aerosol sample from within the mask, either by using a sampling adapter or a test mask with a face piece modified to receive a sampling tube. The two samples are provided, alternately, to a particle measuring device such as a condensation particle counter that generates particle counts indicating the respective concentrations of the tested aerosol samples.

The two counts or measurements are compared by providing a ratio of the count outside the mask to the count inside the mask, known as the "fit factor". A higher fit factor indicates a filtration that more effectively seals against leakage.

The validity of this test is based largely on an assumption that the count or concentration inside the mask is due to leakage rather than penetration through the filter, i.e. an assumption that the filter is nearly 100 percent efficient. The National Institute for Occupational Safety and Health (NIOSH) has classified particulate air-purifying respirators according to 42 CFR Part 84. Three major classes exist within this standard: class 95, 99 and 100. One of the class 95 respirators, known as "N95" filtering facepieces, consist of a mask composed entirely of the filter medium, without a supporting elastomeric mask. The N95 respirator is greater than 95 percent efficient at the most penetrating particle size. Recent regulatory changes have resulted in an upsurge of N95 respirator production and usage, and government regulations continue to require fit-testing.

Typically, filter materials have a minimum efficiency (corresponding to a maximum particle penetration) at a point along a particle size spectrum. Efficiency rises (reflecting reduced penetration) in both directions from the minimum efficiency point. Typically the minimum efficiency point occurs within a particle size range of 0.1- to 0.3-micrometers (μm).

It is known that when a class 95 respirator is exposed to a polydisperse aerosol, a relatively large number of particles at and near the minimum efficiency point pass through the filter and are detected inside the respirator mask. As used in this application, the term "aerosol" refers to a suspension of elements (e.g. solid particles or droplets) in a gaseous medium. Atmospheric or ambient air in an unconditioned state is an example of an aerosol, with air as the gaseous medium supporting typically 3,000-10,000 elements per cubic cm. Ambient air is also an example of a "polydisperse aerosol", because the particles or other elements vary widely in size. By contrast, a "monodisperse aerosol" is comprised of particles at or near a particular diameter. Under certain conditions, the number of particles entering the mask through the filter can be substantially larger than the number entering the mask due to face-seal leakage or other leaks, resulting in a distortion of the calculated fit factor that erroneously indicates a poor fit.

There are several approaches to fit testing class 95 respirators intended to remedy the problems associated with polydisperse aerosol testing. One approach requires that the mask be fitted with a class 99 or class 100 filter for fit test purposes. Such an approach is obviously incompatible with N95 respirators, where there is no supporting elastomeric mask into which the superior filter can be substituted.

Another approach involves generating a suitable monodisperse aerosol, e.g. with all particles at or about 2.5 micrometers in diameter. Dust/mist filters, N95 filters, and other low efficiency filters are considerably more efficient with respect to particles at or near 2.5 microns in diameter. Results based on this type of testing, however, are reliable only if testing occurs within a controlled or conditioned atmosphere including only the monodisperse aerosol. Maintaining this conditioned atmosphere is expensive, requiring an aerosol generator to produce the monodisperse aerosol and a chamber or other enclosure surrounding the person wearing the respirator under test. The enclosure limits the individual's ability to perform certain exercises or movements during fit-testing. This technique is described in an article entitled "Validation of a Quantitative Fit-Test for Dust/Fume/Mist Respirators: Part I", Iverson et al; Applied Occupational Environmental Hygiene, March 1992, pp. 161-167.

Still another approach is based on the discovery that for DM and DFM respirators, the relationship between filter penetration and leakage depends upon the face velocity (flow rate). The approach is described in an article entitled "Fit-Testing for Filtering Face Pieces: Search for a Low-Cost, Quantitative Method", Myojo et al; American Industrial Hygiene Association Journal, 55 (9), 1994, pp. 797-805. Tests were conducted on mannequins and human subjects, both breath-holding and normal breathing. The technique, however, is limited primarily to aerosols in the submicrometer size range. Also, the reliability of tests on human subjects breathing normally depends on the ability to predict and monitor the subject's inhalation rate.

Another known fit-test involves using an optical particle counter in combination with lower efficiency filters, such as dust/mist and N95. The complete polydisperse aerosol is sampled. Due to the limited capacity of the optical particle counter, i.e. its ability to detect only relatively large particles (more than 0.5 microns in diameter), the tendency of penetrating particles to bias leakage test results is reduced. However, the relatively small number of large particles occurring naturally in ambient conditions limits the utility of this approach, because the number of sensed particles is not sufficient to afford statistical accuracy.

U.S. Pat. No. 6,125,845 to Halvorsen et al., assigned the assignee of the instant application and the disclosure of which is hereby incorporated by reference in its entirety except for express definitions contained therein, discloses a system and process for respirator fit-testing that utilizes ambient airborne particles. Halvorsen discloses a system that acquires aerosol samples from inside and outside of the respirator mask, respectively, routing the samples through a radial differential mobility analyzer to modify the samples so that only particle sizes of a predetermined element characteristic (e.g., size) are to be analyzed, and routing the modified samples through a condensation particle counter to determine the concentrations of suspended elements in the respective modified samples. The quotient of the outside to the inside concentration values yields the fit factor.

An advantage of the device disclosed by Halvorsen is that there is no need to generate an aerosol for testing purposes. A problem can arise, however, when the unconditioned ambient atmosphere is of a low particle concentration. A paucity of particles in the aerosol samples can lead to low resolution of the fit factor and/or increase the testing time required to obtain particle counts adequate for a reasonable measure of the fit factor.

An apparatus and method that overcomes problems associated with sparse ambient particle concentrations would be welcome.

SUMMARY OF THE INVENTION

Various embodiments of the invention include an aerosol concentrator that increases the concentration of particles in the aerosol samples by drawing particles out of the unconditioned ambient atmosphere for measurements having higher signal-to-noise ratios and without need for generating additional aerosols to boost the particle concentration.

Also, it has been found that certain types of filters, such as electret filters of the N95 class, are most efficient when the particles are charged. Thus, it is advantageous to avoid the use of neutral particles in the aerosol samples to avoid the detection of particles that have passed through the filter rather than around the filter via leaks. The present invention may be alternatively or additionally configured as a particle separator to exclude neutral particles from the test samples.

In an ambient aerosol, there are typically far fewer charged than uncharged particles. To increase the sensitivity and/or reduce the testing time required, it is desirable to use a high volume of ambient aerosol for the filter system test. In some scenarios, an increase in the volume of ambient aerosol particles of an order of magnitude may be desired.

One approach is to simply increase the flow rate of the incoming ambient aerosol so that a larger aerosol sample adequately sized for sparsely concentrated ambient aerosols is acquired in a shorter time span. However, condensation particle counters (CPCs) that draw low flow rates (e.g., 0.1 liters/minute) are often preferred for testing systems that are field deployed because their power consumption is amenable to battery operation. These low flow rate CPCs are not well suited for handling the higher volumetric flows contemplated (approximately 1 liter/minute) to accomplish the desired particle population in some instances.

For example, higher volumetric flows reduce the residence time of the particle in the probe volume of the CPC in proportion to the increased flow rate, which can reduce the resolution of the particle counter. Also, the operating temperatures of the saturator and the condenser of the CPC can be adversely affected by the high flow rates, thus causing their calibrations to be unreliable or unstable. Higher-flow CPCs can be designed, but are bulky and consume too much power for practical use in certain applications (e.g. field testing).

Another approach is to actively increase the ambient particle concentration by introducing an aerosol. Such an approach is generally undesirable due to the liabilities that an aerosol laden atmosphere presents, including harm to equipment and surfaces that are in the environment and adverse health effects to personnel. The ambient environment area could be limited to a contained region, such as by placing a chamber or tent over the test system intake, but the appurtenances required adds bulk to the system and detracts from the compactness that is desirable in field testing. In either case, there is the procurement and maintenance costs of an auxiliary aerosol generator.

To address these concerns, various embodiments of the invention utilize a technique wherein the charged particles from the large volumetric flow (hereinafter "major flow") are concentrated into a smaller volumetric flow (hereinafter "minor flow") that is more suitable for handling by existing particle detectors.

The filtering efficiency of class 95 filters, particularly of the electret type, can be a function not only of size but also of electrical charge. That is, in certain particle size regimes, charged particles are filtered more efficiently by class 95 filters than are neutral particles. Accordingly, embodiments of the invention separate out the neutral particles from the charged particles of a given polarity and are arranged so that only charged particles are delivered for measurement of concentration.

Various embodiments of the invention utilize an electric field to transfer charged particles from the major flow to the minor flow, thereby increasing the concentration of charged particles in the minor flow. Simultaneously, by filtering the minor flow at the inlet to remove all particles, and by providing a slight excess of filtered air at the minor flow inlet, a net flow of gas from the minor flow into the major flow can serve as a purge mechanism that further prevents neutral particles from entering the minor flow.

DETAILED DESCRIPTION OF CERTAIN EMBODIMENTS

Figure 1:
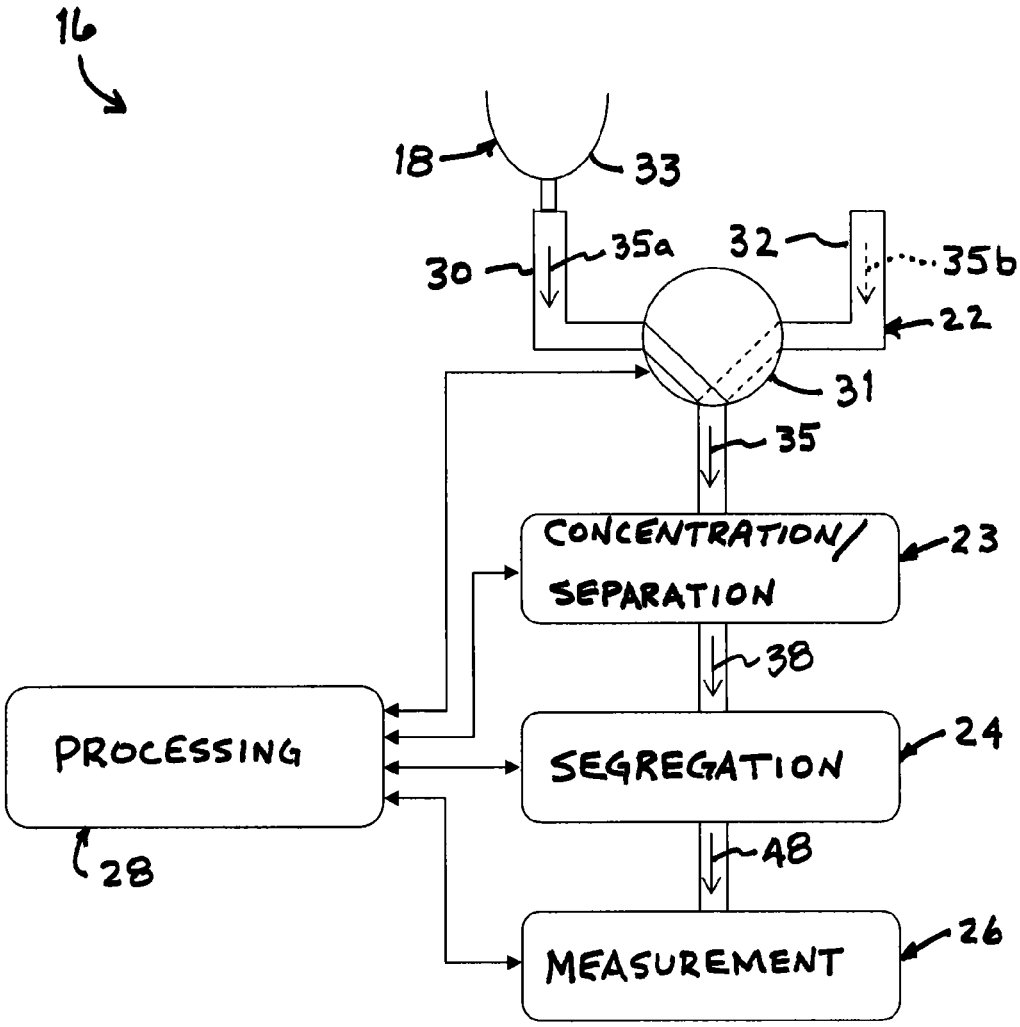
FIG. 1 is a schematic of a testing system in an embodiment of the invention.

Referring to FIG. 1, a testing system 16 for evaluating a filtration device 18 for leakage is depicted in an embodiment of the invention. The testing system 16 includes an aerosol sampling stage 22, an aerosol concentration/separation stage 23, an aerosol element segregation stage 24 and a concentration measuring stage 26, all in fluid communication with each other. The testing system 16 may also include a processing stage 28 operatively coupled to the other stages 22, 23, 24 and 26.

The sampling stage 22 may comprise a pair of sampling conduits 30 and 32 that are isolated from each other with a three-way valve 31. Sampling conduits 30 and 32 are adapted to extract a test aerosol sample 35*a* from inside of a respirator mask 33 and alternatively a reference aerosol sample 35*b* from the unconditioned ambient atmosphere (the test and reference aerosol samples 35*a* and 35*b* being interchangeably referred to herein as a drawn aerosol sample 35). The 3-way valve 31 is depicted in FIG. 1 in a configuration to draw test aerosol sample 35*a*, with the alternative configuration for drawing reference aerosol sample 35*b* depicted in phantom. Sampling conduit 32 includes an entrance port 36 that may be positioned proximate the mask but outside of it, thus drawing the reference aerosol sample 35*b* from the unconditioned atmosphere or environment immediately surrounding the mask under test.

The aerosol concentration/separation stage 23 may comprise an electrostatic or charged particle aerosol concentrator or an inertial separation device such as a slot impactor. The aerosol concentration/separation stage 23 may be configured to intake a large volume of drawn aerosol sample 35 and to deliver a modified aerosol sample 38. When used as a flow concentrator, the drawn aerosol sample 35 and the modified aerosol sample 38 are also referred to herein as the "major flow" and the "minor flow," respectively. In addition or in the alternative, the aerosol concentration/separation stage 23 may be configured to eliminate neutral particles from the drawn aerosol sample 35 so that the modified aerosol sample 38 comprises only charged particles.

The aerosol element segregation stage 24 may comprise a radial differential mobility analyzer (radial DMA), an impactor, or other devices suitable for segregating particles based on a predetermined element characteristic. The aerosol element segregation stage 24 may be arranged to deliver a segregated aerosol sample 48 to the measuring stage 26. The segregated aerosol sample 48 includes, alternatively, a first segregated aerosol sample based on the original sample taken from within respirator mask 33, and a second segregated sample originating from the unconditioned ambient atmosphere outside the respirator.

It is noted that, for certain embodiments, the aerosol element segregation stage 24 may not be necessary. The aerosol concentration/separation stage 23 may be tailored to pass on particles having only the desired predetermined element characteristics without need for further segregation. Such an embodiment is discussed below attendant FIG. 2.

The concentration measuring stage 26 comprises a device that can measure the particle concentration of the segregated aerosol 48. A CPC is particularly well suited for modified aerosol samples 48 having a substantial population of less than 1-μm diameter. An aerosol electrometer, such as the TSI Model 3068B, is also suitable in this size range. For segregated aerosol samples 48 comprised mainly of particles larger than 0.5-μm diameter, an optical particle counter or photometer may be used to generate concentration values. Thus, measurement of scattered light intensities can be used in lieu of particle counting. In one embodiment, the flow rate of the segregated aerosol sample 48 is determined at least in part by the particle counter or other measuring device of the measuring stage 26.

The respective concentration values are provided to processing stage 28, where they are compared to generate a ratio of the ambient concentration value to the mask concentration value (i.e. the fit factor).

In operation, the testing system 16 is used to conduct quantitative fit-tests on filtration devices such as an air purifying respirator 18. In one embodiment, the test mask 33 is donned on an individual to define an internal breathing chamber between the test mask 33 and the individual. The test mask 33 may be equipped with a face-piece probe for coupling with the conduit 30 and providing access to the internal breathing chamber. Aerosol samples are alternatively drawn from the internal breathing chamber inside the respirator mask 33 and from the local unconditioned ambient atmosphere and directed to a common branch 37 of the three-way valve 31 and passed on to the aerosol concentration/separation stage 23.

At the concentration/separation stage 23, the particles from the respective drawn samples may be concentrated and/or the neutral particles separated from the flow. In one embodiment, the volume of the drawn samples can be substantially larger than the segregated aerosol samples 48 that are passed on to the measuring stage 26. At least a portion of all the particles present in the drawn sample are concentrated into the modified aerosol sample 38. In another embodiment, a charged particle aerosol concentrator may be used that draws only charged particles into the segregated aerosol sample 48 (described later in more detail).

At the aerosol element segregation stage 24, each of the aerosol samples is segregated in accordance with the type of mask being tested. Some of the polydisperse suspended elements (usually particles) in the aerosol are segregated according to their size, charge and/or another suitable characteristic, to provide in each case the segregated aerosol sample 48, in which the suspension consists of those particles for which the respirator filter medium is highly efficient. In other words, particles which have an unacceptably high penetration into the filter are excluded from the sample by selecting a particle regime for the segregated aerosol sample 48 that is outside the region of high penetration. The resulting segregated aerosol sample 48 can be either monodisperse or polydisperse, but having a sufficiently low penetration with respect to the material of the filter element under test to justify an assumption that virtually all of such particles found in the respirator sample entered the mask due to leakage.

The concentration measuring stage 26 receives the segregated aerosol sample 48 from the aerosol element segregation stage 24. The testing system 16 may be configured to extract the reference aerosol sample 35*b* from the unconditioned ambient atmosphere for a sampling period that is long enough and at a high enough volumetric flow rate to establish baseline concentration measurement to within a known uncertainty. The sampling period and/or the volumetric flow rate may be set at a predetermined value, or adjusted in situ. Thereafter, the corresponding test aerosol sample 35*a* is extracted using the same volumetric flow and sampling period.

Figure 2:
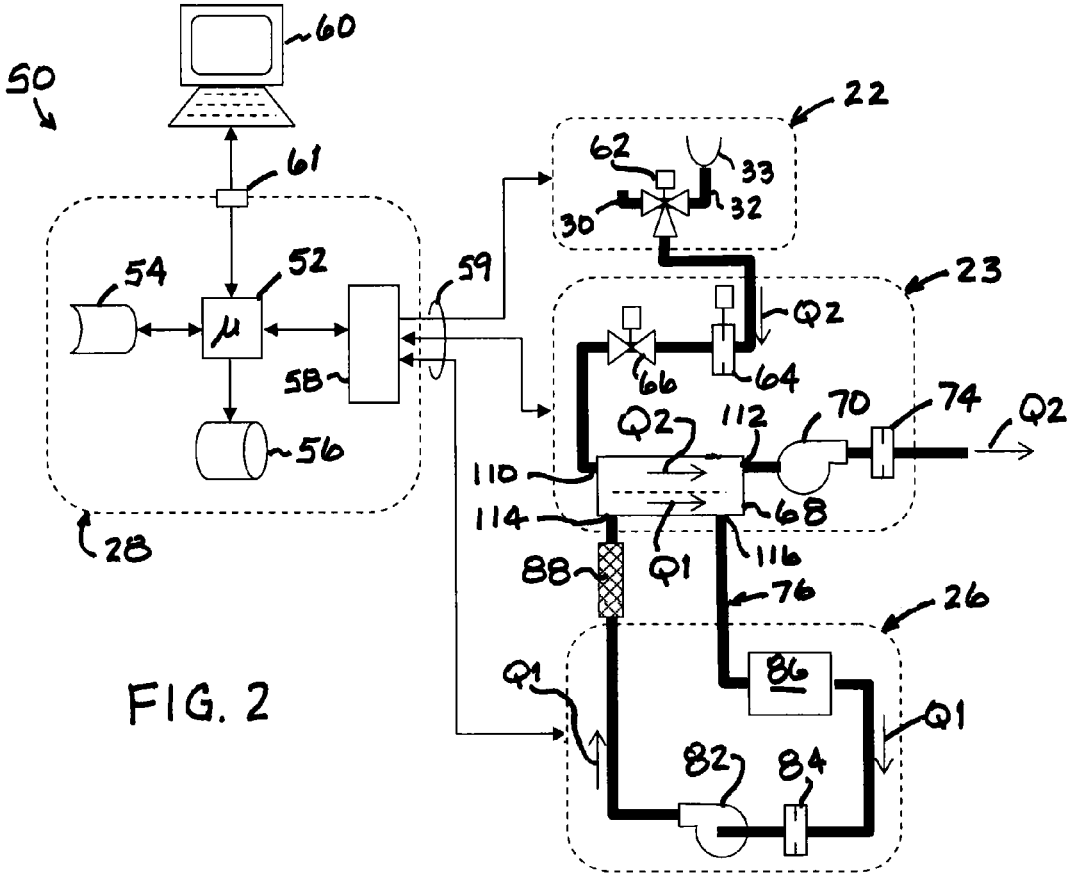
FIG. 2 is a control schematic of a first testing system in an embodiment of the invention.

Referring to FIG. 2, a test system 50 is depicted implementing only the sampling stage 22, the aerosol concentration/separation stage 23, the concentration measuring stage, and the processing stage 28 (i.e. no separate segregation stage 24) in an embodiment of the invention. In this embodiment, the processing stage 28 includes components for control and data acquisition of the testing system 50, comprising a microprocessor 52 operatively coupled with a programmable memory such as a programmable read-only memory (PROM) device 54, a data storage device 56 and an interface 58 for manipulation of various control devices. Communication with the various stages 22, 23, 24 and 26 are provided via signal lines 59 in this embodiment. (For the sake of clarity of FIG. 2, the signal lines 59 are depicted only as interfacing with the various stages 22, 23 and 26, and not to each individual component therein.) A remote computer 60 may also access the microprocessor 52 via an I/O communication port 61 (e.g., RS232 port, USB port, or a wireless communications port) to perform such tasks as modifying instructions contained in the PROM device 54 and uploading data from the data storage device 56.

In the test system 50 embodiment, the sampling stage 22 includes a power actuated 3-way valve 62 that is controlled by the microprocessor 52. The concentration/separation stage 23 may include a variable restriction device 64 such as a servo controlled variable orifice, a power actuated isolation valve 66 and a charged particle aerosol separator/concentrator 68, and a major flow source 70 such as an electric powered pump that draws a major flow Q2 through the charged particle aerosol separator/concentrator 68 and is in fluid communication with a flow meter 74.

The aerosol concentration/separation stage and concentration measuring stages 23 and 26 may include a minor flow loop 76 that generates and segregates a minor flow Q1, the minor flow loop 76 comprising a minor flow source 82, a flow meter 84 and a CPC 86. The minor flow loop 76 may also include a filter 88 such as a HEPA filter to remove particles from the minor flow Q1 prior to interaction with the major flow Q2.

The flow meters 74 and 84 can be of any type available to the artisan (e.g., orifice, venturi, turbine meter, hot wire anemometer) and may be equipped with a transducer to generate an output signal for reading by the processing stage 28. Alternatively, the a common pump may replace the major and minor flow sources 70 and 82 with valving for apportionment between the major and minor flows (not depicted).

In operation, the microprocessor 52 of the test system 50 embodiment accesses instructions in the PROM device 54 to configure the power actuated 3-way valve 62 so that the reference aerosol sample 35*b* will be drawn through the sampling conduit 32. An instruction from the PROM device 54 may then be read by the microprocessor 52 to energize the major and minor flow sources 70 and 82. The microprocessor 52 may adjust the variable restriction device 64 to a predetermined position and open the power actuated isolation valve 66 to draw a reference aerosol flow Qb that constitutes the major flow Q2 from the ambient air into the test system 50 via sampling conduit 32. The microprocessor 52 may read the output of the flow meters 74 and 84, convert the respective readings to flow rates, and record the readings and/or flow rates to the data storage device 56.

The microprocessor 52 may be instructed to hold the power actuated isolation valve 66 open for a predetermined sampling period. The microprocessor 52 may also actively control the charged particle aerosol separator/concentrator 68 for separation and/or concentration of the reference aerosol sample 35*b*. (More details on this aspect are provided below.) The microprocessor 52 may also arm or control the CPC 86 to measure the segregated aerosol sample 48 during the sampling period. After the sampling period expires, the power actuated isolation valve 66 is closed. The microprocessor 52 may acquire a measured output value from the CPC 86 and enter it as a reference data point in the data storage device 56.

The microprocessor may then be instructed to configure the power actuated 3-way valve 62 so that the test aerosol sample 35*a* will be drawn through the sampling conduit 30, followed by substantially the same set of instructions to acquire and store a test data point. When the power actuated 3-way valve is configured this way, a test aerosol flow Qa constitutes the major flow Q2. The microprocessor 52 may then compute the quotient of the test data point to the reference data point to provide the fit factor. Alternatively, the microprocessor 52 may be instructed to acquire and store multiple reference and test data points and determine the fit factor from the averages of the respective reference and test data points.

In an alternative embodiment, the PROM device 54 may instruct the microprocessor 52 to compare the reference data point against a threshold value (for example, a threshold signal level or a threshold number of counts). If the reference data point does not exceed the threshold value, the microprocessor 52 may be instructed to increase the sampling period and/or the volumetric flow rate and repeat the acquisition of the reference data point. Repeat acquisitions of the reference data point may be continue until the threshold value is exceeded. The sampling period and the variable orifice setting that produced the satisfactory data point may subsequently be stored in the storage device 56 for recall in future data acquisitions.

In yet another alternative embodiment, the position of the variable orifice and/or the sampling period need not be predetermined, but rather taken from the remote computer 60 via the I/O communication port 61. Such an embodiment enables an operator to establish the settings of the sampling period and variable orifice position and to store the settings to the storage device 56.

Figure 3:
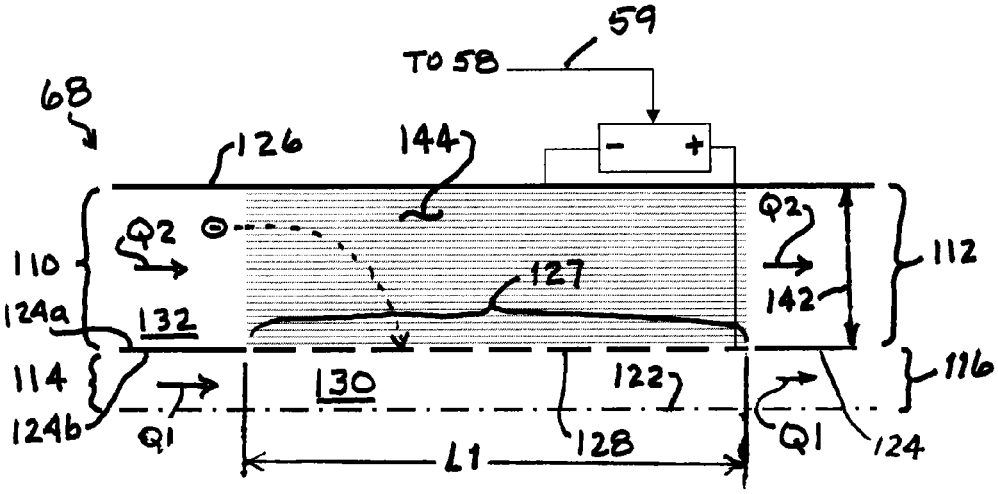
FIG. 3 is a partial sectional view of a coaxial particle concentrator in an embodiment of the invention.

Referring to FIG. 3, one embodiment of the charged particle aerosol concentrator 68 is depicted and described in more detail. The charged particle aerosol concentrator 68 as depicted therein includes a major flow inlet 110, a major flow outlet 112, a minor flow inlet 114 and a minor flow outlet 116. In one embodiment, the charged particle aerosol concentrator 68 comprises an inner conduit 124 and an outer conduit 126 that are concentric about a centerline axis 122 (as depicted). One or both of the inner and outer conduits 124 and 126 may comprise a metal or other electrical conductor.

The inner and outer conduits 124 and 126 may define a central flow passage 130 and an annular flow passage 132 that are substantially concentric so that the major and minor flows Q2 and Q1 within the charged particle aerosol separator/concentrator 68 flow in directions that are substantially parallel to each other. The inner conduit 124 establishes a common wall or barrier shared by both the central and the annular flow passages 130 and 132, defining flow boundaries 124*a* and 124*b*. The flow boundaries 124*a* and 124*b* may be interrupted by a breach 127 such as a window in the inner conduit 124 or a gap between segments of the inner conduit 124. The breach 127 may define a dimension L1 that is substantially parallel to the direction of major and minor flows Q2 and Q1 and providing fluid communication between the central and annular flow passages 130 and 132.

An electrically conductive structure 128 may be coupled to or integral to the inner conduit 124. As a separate structure that is coupled to the conduit 124, the electrically conductive structure 128 bridges the breach 127 over at least a portion of its length. Such electrically conductive structure 128 may comprise a woven mesh, wire or ribbon arrays, perforated plates or cylinders, and/or porous open cell matrices. As a structure that is integral to the inner conduit 124, the electrically conductive structure 128 may comprise perforations, slots or other geometries defined within or over the breach 127 that enables fluid communication between the central and annular flow passages 130 and 132. Accordingly, the electrically conductive structure 128 is in fluid contact with both the central and the annular flow passages 130 and 132.

In one embodiment, the minor flow Q1, having been filtered by filter 88, comprises a clean gas that is introduced into the central flow passage 130. Herein, a "clean gas" is understood to be a gas that has an acceptably low particle concentration in the element characteristic regime of interest at the inlet of the charged particle aerosol concentrator 68. The major flow Q2 comprising aerosol particles may be introduced into the annular flow passage 132. The major and minor flows Q1 and Q2 may be tailored to flow at substantially the same velocity, so that there is substantially no pressure difference between the central and annular flow passages 130 and 132. The aerosol particles of the major flow Q2 may comprise both charged and uncharged particles. A voltage source 140 may be used to introduce a DC voltage potential 142 between the inner conduit 124 and the outer conduit 126, thereby generating an electric field 144 in the annular flow passage 132. The electric field 144 may be of either direction; that is, the electric field 144 may be set up to repel either positively or negatively charged particles towards the minor flow Q1.

In operation, the major flow Q2 may be of a large volumetric displacement in relation to the minor flow Q1, and may thereby include a relatively large number of both charged and uncharged aerosol particles. The electric field 144 tends to drive particles of a selected polarity (depicted in FIG. 3 as negative) away from the outer conduit 126 and towards the electrically conductive structure 128 of the inner conduit 124. At least a portion of the particles may be transferred to the minor flow Q1, either by virtue of the electric field or by diffusion, and enter the minor flow Q1 and flow out an exit 146 end of the central flow passage 130. The uncharged and opposite polarity particles are exhausted with the major air flow via the major flow source 70. By this arrangement, the particles transferred to the minor flow Q1 will possess the elemental characteristic of having the same polarity. An outer limit of the increase in concentration of particles having the same polarity within the minor flow Q1 is given by the ratio of the rates of the major to the minor flow, i.e. $Q_2/Q_1$.

The charged particle aerosol concentrator 68 may also be tailored to draw particles above a certain electrical mobility into the minor flow Q1. Particles having greater electrical mobility are more readily drawn laterally across the major flow Q2 than are particles having lesser electrical mobility. Accordingly, only particles having enough electrical mobility to traverse at least a portion of the major flow Q2 before passing breach 127 can be entrained in the minor flow Q1. The cut-off with respect to electrical mobility of the particles thus entrained in the minor flow Q1 may tend to be gradual, as some particles of marginal electrical mobility may or may not be transferred to the minor flow Q1 depending on their incoming radial location at the major flow inlet 110. In addition to the dimension L1, the cut-off is affected by the velocity of the major flow Q2 and the strength of the electric field 144. These parameters can be tuned in operation to affect the cut-off.

The elemental characteristic of electrical mobility may be related to the size of the particles, as larger particles will possess greater viscous drag than smaller particles, thus having less electrical mobility in the lateral direction. Accordingly, the charged particle aerosol concentrator 68 may deliver particles having common polarity and a threshold electrical mobility, as well as sufficient segregation with relation to size to negate the need for a separate size segregation stage.

When used as a concentrator, the charged particle aerosol concentrator 68 inherently isolates the neutral particles from the minor flow Q1. The charged particle aerosol concentrator 68 may also be designed or used solely as a separator. That is, the volumetric flow rates of the major and minor flows Q2 and Q1 may be matched so that there is effectively no concentration of incoming particles, only separation of particles having a given polarity from the particles that are neutral or having the opposite polarity.

Other embodiments (not depicted) may comprise parallel, non-concentric conduits that define a major flow passage and a minor flow passage that share a barrier therebetween (e.g., two rectangular passages in a side by side arrangement), the common barrier having a window region that enables fluid communication between the two conduits and an electrically conductive structure disposed over or integrally defined within the window region. The same principles of concentration/separation may be employed by providing for electrical isolation between the common barrier and an opposing wall of the major flow passage, or by other ways to introduce an electrical field within the major flow passage adjacent the window region.

Figure 4:
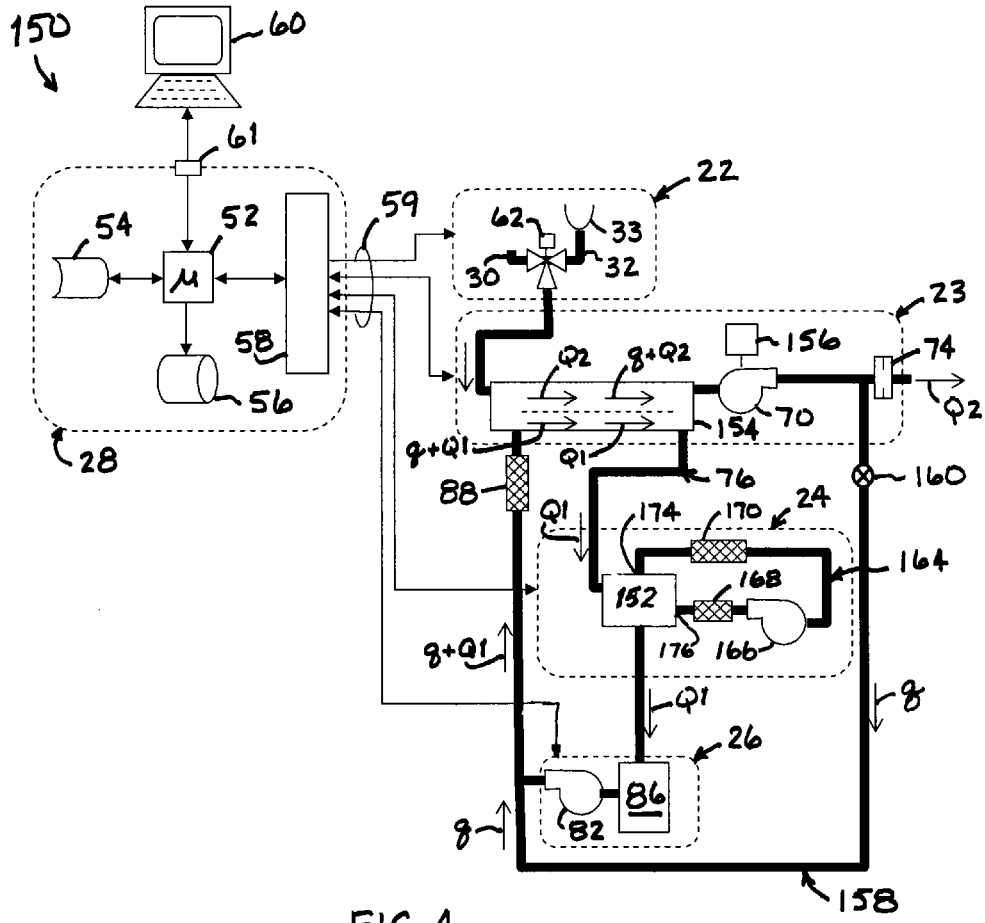
FIG. 4 is a control schematic of a second testing system in an embodiment of the invention.

Referring to FIG. 4, a modified test system 150 is depicted in an embodiment of the invention. The modified test system 150 includes many of the same components and aspects as the test system 50 (FIG. 2), which are designated by the same numerical callouts. The modified test system 150 includes the segregation stage 24 and includes a radial DMA 152.

Figure 5:
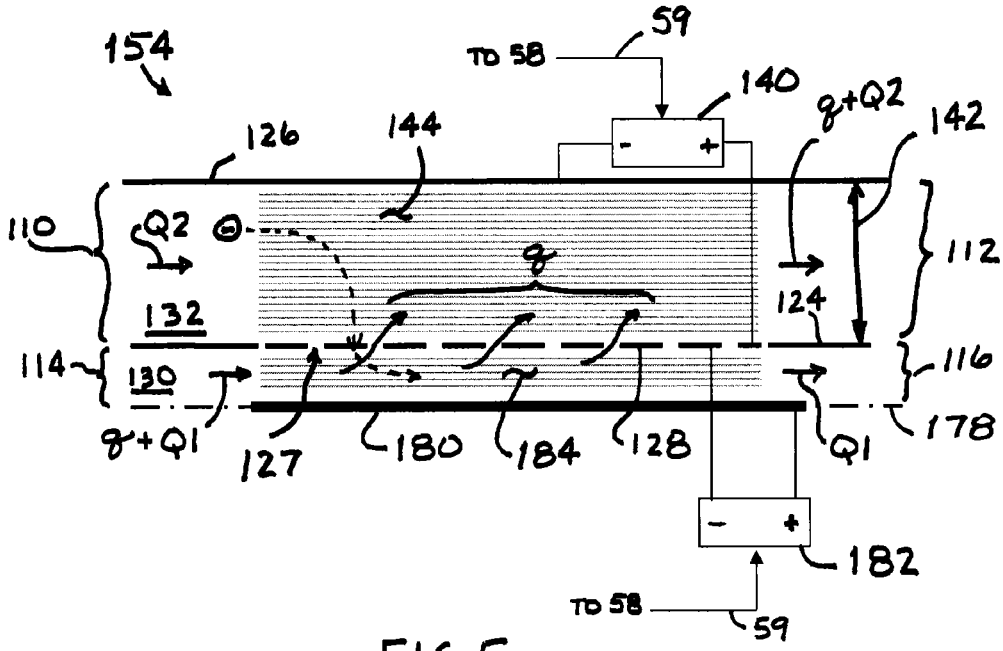
FIG. 5 is a partial sectional view of a modified coaxial particle concentrator in an embodiment of the invention.

In the modified test system 150 embodiment, the concentration/separation stage 23 includes a dual element charged particle aerosol concentrator 154, discussed in detail in reference to FIG. 5. The concentration/separation stage 23 further includes a variable speed drive (VSD) 156 to control the flow rate of the major flow Q2, thus negating the need for an isolation valve and variable restriction device.

The microprocessor 52 may communicate with the radial DMA 152 of the segregation stage 24 to control, for example, enablement of the DMA 152 and the flow rate drawn therethrough. An example of the DMA 152 that performs these functions is the TSI Model 8038 PortaCount Pro+Respirator Fit Tester.

The modified test system 150 further comprises an auxiliary flow loop 158 that introduces an auxiliary clean gas flow q into the minor flow loop 76. In one embodiment, the auxiliary flow loop 158 is sourced by the major flow source 70 and adjusted or controlled to a desired flow rate with a flow valve 160. The auxiliary clean gas flow q is added to the minor flow Q1 at the junction of the auxiliary and minor flow loops 158 and 76 and is cleansed by the filter 88 prior to entering the dual element charged particle aerosol concentrator 154.

The segregation stage 24 of the modified test system 150 can provide enhanced segregation of the minor flow Q1 that enters the CPC 86, in particular with respect to the size regime of the particles. The segregation stage 24 includes a sheath air flow loop 164 comprising a sheath air flow source 166 and filters 168 and 170. The sheath air flow loop 164 draws air from an excess air port 174 of the DMA 152 and returns it to a first DMA inlet 176 for eventual merger with the minor flow Q1 within the DMA 152.

Referring to FIG. 5, the dual element charged particle aerosol concentrator 154 is depicted in an embodiment of the invention. In this embodiment, the inner and outer conduits 124 and 126 are coaxial, defining a centerline axis 178. The dual element charged particle aerosol concentrator 154 may further include a center rod or wire 180 that may be substantially aligned with the centerline axis 178 and may be electrically biased with an auxiliary voltage source 182 to create a secondary electrical field 184 within the inner conduit 124. The secondary electrical field 184 is of the same direction as the electric field 144.

Functionally, the auxiliary flow q is added to the minor flow Q1 and can cause the inner passage 130 to operate at a higher pressure than the annular flow passage 132, thus causing a portion q+Q1 flow equivalent to the auxiliary flow q to flow radially outward from the central flow passage 130 through the electrically conductive structure 128 and into the annular flow passage 132. By this mechanism, only charged particles are motivated to migrate radially inward against the radially outward flow. Neutral particles, impervious to the electric field 144, are carried away from the electrically conductive structure 128 and the central flow passage 130 by the radial outward flow.

The secondary electric field 184 may be strong enough to improve particle penetration into the minor flow Q1 (that is, to attract particles through rather than to the electrically conductive structure 128) without being so strong as to precipitate the particles before they exit the inner conduit 124.

Figure 6:
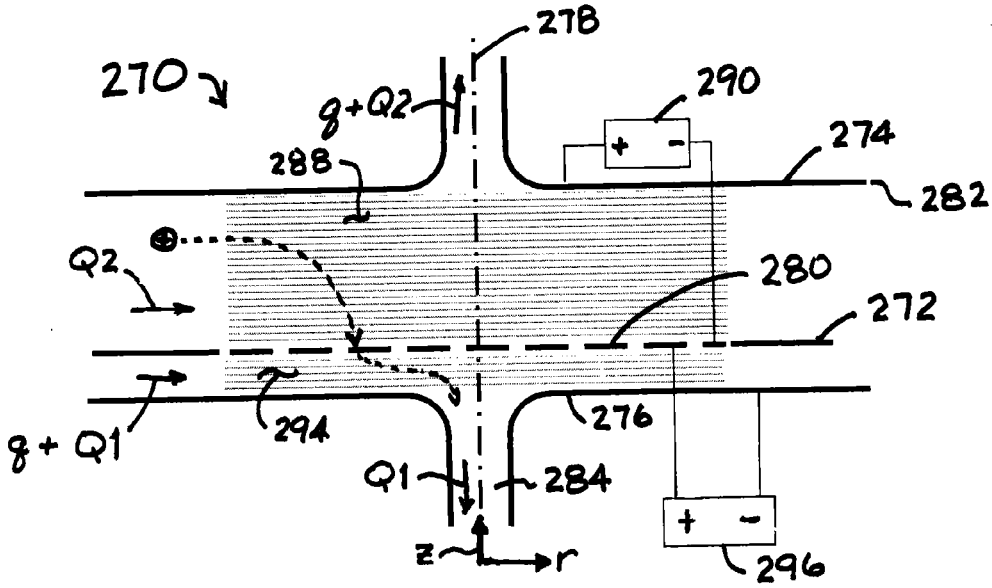
FIG. 6 is a partial sectional view of a radial particle concentrator in an embodiment of the invention.

Referring to FIG. 6, a dual element radial concentrator 270 comprising a disk electrode 272 positioned between an upper housing 274 and a lower housing 276 is depicted in an embodiment of the invention. The disk electrode 272 and upper and lower housings 274 and 276 are substantially parallel with respect to each other and may be rotationally symmetric about a central axis 278. The disk electrode may comprise an electrically conductive structure 280 akin to the electrically conductive structure 128 of the coaxial embodiments. The major and minor flows Q1 and Q2 may have the same characteristics as described in the previous embodiments, and may be directed radially inward, i.e. from an outer rim 282 of the radial concentrator towards a central passage 284. The minor flow may incorporate the auxiliary flow q.

A first electrical field 288 may be generated by a main bias source 290 operatively coupled between the upper housing 274 and the disk electrode 272. A second electrical field 294 may be generated by a second voltage source 296 operatively coupled between the lower housing 276 and the disk electrode 272. The main and second voltage sources in the depicted embodiment are configured to produce electrical fields 288 and 294 that draw positively charged particles into the minor flow Q1.

In operation, the radial concentrator 270 functions in a manner similar to, and can be used in place of, the coaxial concentrators 68 and 154. The first electrical field 288 causes particles having a certain polarity to migrate away from the upper housing 274 toward the disk electrode 272. The electrically conductive structure 280 of the disk electrode 272 may enable passage of the charged particles. The second electrical field 294 may provide extraction bias that draws the particles through the electrically conductive structure 280. The auxiliary flow q can cause a pressure difference and subsequent flow across the electrically conductive structure 280 of the disk electrode 272 and against the direction of charged particle migration, thereby repelling neutral particles. The resulting outflow Q1 through the lower housing 276 can have an increased concentration of charged particles relative to the major flow Q2.

The various embodiments of concentrators/separators are interchangeable between the various test systems 50 and 150, both physically and functionally. That is, each of the various concentrators/separators described herein (e.g., concentrators 68, 154 and 270) can be designed and operated to deliver minor flows Q1 having substantially the same elemental characteristics. Those skilled in the art will recognize that other configurations of electrodes, mesh elements, etc. can be used to separate and concentrate the charged portion of the particles in a flowing aerosol. For example, a duct of any cross section, such as a rectangular or oval duct, concentric and non-concentric, can be equipped with appropriate perforated walls and potentials to perform the concentration/separation function.

The various embodiments disclosed herein may require additional appurtenances such as a vacuum or pressure source to accomplish functional and operational characteristics of the invention, even though they are not depicted in the Figures. Selection and implementation of such appurtenances are readily apparent by those skilled in the relevant arts, the absence of which from the figures do not detract from the essential spirit of the invention.

Each of the figures and methods disclosed herein may be used separately, with each other or in conjunction with other features and methods, to provide improved devices, systems and methods for making and using the same. Combinations of features and methods disclosed herein may not be necessary to practice the invention in its broadest sense and are instead disclosed merely to particularly describe representative embodiments of the invention.

For purposes of interpreting the claims for the present invention, it is expressly intended that the provisions of Section 112, sixth paragraph of 35 U.S.C. are not to be invoked unless the specific terms "means for" or "step for" are recited in the subject claim.

What is claimed is:

1. A process for the quantitative fit-testing of a respirator, comprising:

fitting a respirator having a filter to an individual, said respirator cooperating with the individual's face to define an internal breathing chamber;

collecting a first aerosol sample from outside of said respirator;

collecting a second aerosol sample from said breathing chamber;

separating elements suspended in said first aerosol sample according to a first element characteristic;

concentrating said first aerosol sample to produce a first modified aerosol sample;

separating elements suspended in said second aerosol sample according to said first element characteristic;

concentrating said second aerosol sample to produce a second modified aerosol sample; and generating first and second aerosol concentration values to indicate concentrations of selected suspended elements having said first element characteristic in said first and second modified sample, respectively.

2. The process of claim 1 wherein said steps of concentrating and separating of a given one of said first and second aerosol samples are performed simultaneously.

3. The process of claim 1 wherein said first element characteristic is polarity.

4. The process of claim 1 wherein said first and second modified samples include only elements that exceed a fractional filtration efficiency threshold with respect to said filter.

5. The process of claim 1 further comprising:

segregating elements suspended in said first modified aerosol sample according to a second element characteristic to produce a first segregated sample; and segregating elements suspended in said second modified aerosol sample according to said second element characteristic to produce a second segregated sample, wherein said step of generating first and second aerosol concentration values indicates concentrations of selected suspended elements having said second element characteristic in said first and second segregated sample, respectively.

6. The process of claim 5 wherein the second element characteristic is one of electrical mobility and size.

7. The process of claim 5 wherein said steps of concentrating, separating and segregating of a given one of said first and second aerosol samples are performed simultaneously.

8. The process of claim 5 wherein said first and second modified samples include only elements that exceed a fractional filtration efficiency threshold with respect to said filter.

9. The process of claim 1 wherein said step of generating of the first and second concentration values comprises measuring scattered light intensities.

10. A method for separating suspended elements in an aerosol flow according to an element characteristic, comprising:

providing an aerosol separation device including a first conduit and a second conduit defining first and second flow passages, at least one of said first and second conduits defining a breach that enables fluid communication between said first and second flow passages, and a first electrically conductive structure arranged within or proximate said breach and in fluid contact with said first and second flow passages;

establishing a clean gas flow through said first flow passage, establishing an aerosol flow through said second flow passage, said aerosol flow including a plurality of charged particles;

using said first electrically conductive structure to generate an electric field within said second conduit proximate said breach to transfer a portion of said charged particles to said clean gas flow, said portion of said charged particles having a predetermined element characteristic; and measuring the concentration of particles transferred to said clean gas flow in said step of using.

11. The method of claim 10, further comprising establishing an auxiliary clean gas flow that is added to said clean gas flow upstream of said breach, said auxiliary flow creating an excess volumetric flow in said first flow passage that is transferred to said second flow passage via said breach.

12. The method of claim 10 wherein:

said steps of establishing establishes said aerosol flow at a substantially greater volumetric flow rate than said clean gas flow;

said clean gas flow and said aerosol flow pass by said breach at substantially the same velocity; and the concentration of particles in said aerosol flow having said predetermined element characteristic is less than the concentration of particles transferred to said clean flow.

13. A method for the quantitative fit-testing of a respirator, comprising:

providing an aerosol separation device arranged to receive an aerosol flow, said aerosol flow including a plurality of charged particles, said aerosol separation device including a first conduit and a second conduit defining first and second flow passages, said first flow passage arranged for intake of a clean gas flow, said second flow passage arranged for intake of said aerosol flow, at least one of said first and second conduits defining a breach that enables fluid communication between said first and second flow passages, a first electrically conductive structure arranged within or proximate said breach and in fluid contact with said first and second flow passages, and a first voltage source operatively coupled with said first electrically conductive structure for generation of an electric field within said second flow passage;

providing a concentration measuring stage in fluid communication with said first flow passage of said aerosol separation stage; and providing a processing stage operatively coupled to said aerosol separation device and said concentration measuring stage, said processing stage including components for control and data acquisition of said testing system, said components including a microprocessor operatively coupled with a programmable memory, said programmable memory including instructions readable by said microprocessor, said instructions including:

establishing said clean gas through said first flow passage, establishing said aerosol flow through said second flow passage, energizing said voltage source, and measuring the concentration of particles transferred to said clean gas flow in said step of energizing.

14. The method of claim 13 further comprising providing a data storage device operatively coupled to said microprocessor for storage of values acquired by or computed by said microprocessor.

15. The method of claim 13 further comprising:

providing a second electrically conductive structure arranged within said first flow passage and a second voltage source operatively coupled with said second electrically conductive structure for generation of an electric field within said first flow passage, and wherein said instructions readable by said microprocessor further comprise energizing said second voltage source.

16. The method of claim 13 wherein said aerosol separation device provided in the step of providing said aerosol separation device is also an aerosol concentrating device, said aerosol flow being greater than said clean gas flow.

17. The method of claim 13 further comprising providing an auxiliary flow source that sources an auxiliary clean gas flow that is added to said clean gas flow upstream of said breach, wherein a volume of gas substantially equal to said auxiliary clean gas flow is transferred from said first flow passage to said second flow passage via said breach.

* * * * *